US005238591A

United States Patent [19]

Flickinger

[11] Patent Number: 5,238,591

[45] Date of Patent: Aug. 24, 1993

[54] ANTI-SLUDGE COMPOSITION AND PROCESS FOR TREATING TRANSMISSION OIL

[76] Inventor: Harold T. Flickinger, 6485 Creation St., St. Cloud, Fla. 34771

[21] Appl. No.: 907,060

[22] Filed: Jul. 1, 1992

[51] Int. Cl.[5] ..... C10M 105/08

[52] U.S. Cl. ..... 252/52 R; 252/58; 252/73; 252/364

[58] Field of Search ..... 252/52 R, 58, 364, 73

[56] References Cited

U.S. PATENT DOCUMENTS

| | | | |
|---|---|---|---|
| 1,857,501 | 5/1932 | Gallagher | 252/56 R |
| 1,986,645 | 1/1935 | Prutton | 87/9 |
| 1,986,651 | 1/1935 | Prutton | 87/9 |
| 2,069,626 | 7/1934 | Roehner | 87/9 |
| 2,151,353 | 3/1939 | Montgomery | 205/21 |
| 2,259,872 | 10/1941 | Baldeschwieler | 252/171 |
| 2,279,001 | 4/1942 | Matheson et al. | 184/1.5 |
| 2,312,790 | 3/1943 | Backoff et al. | 44/56 |
| 2,339,096 | 1/1944 | Morgan | 252/171 |
| 3,314,884 | 4/1967 | Cover | 252/10 |

*Primary Examiner*—Paul Lieberman
*Assistant Examiner*—Michael Tierney
*Attorney, Agent, or Firm*—Walter J. Monacelli

[57] ABSTRACT

The composition and process described herein involve a mixture of parts by weight approximately 30–50% toluene, 12–28% acetone, 12–28% dichlorobenzene,, 5–15% thin motor oil and 5–20% of kerosene, preferably 40%, 20% 20%, 10% and 10% respectively. This mixture may be added to and left in the transmission oil for prolonged periods or may be drained with the transmission after thorough mixing or after a short period of operation, the mixture of transmission oil and additives may be drained and replaced with fresh transmission oil. In each of these cases there is improved operation of the transmission.

5 Claims, No Drawings

ANTI-SLUDGE COMPOSITION AND PROCESS FOR TREATING TRANSMISSION OIL

BACKGROUND OF THE INVENTION

1. Field of the Invention

This invention relates to a composition and a process for treating a transmission oil containing deposits or sludge therein. More specifically it relates to such a composition containing a mixture of solvents for dissolving such deposits or sludge in the transmission oil. Still more specifically it relates to the removal of or rendering less harmful such deposits or sludge and reconditioning the transmission oil for further use or conditioning the transmission oil for removal of the deposits or sludge with the transmission oil and replacement with fresh transmission oil.

2. State of Prior Art

The development of sludge and sludge deposits in transmission oil in automobile and truck hydraulic transmission systems has been a continuing problem. The presence of such materials slows and detracts from the efficient transmission of power to the driving system, sometimes causing a definite drag on the system Various solvents and mixtures thereof have been used for various cleaning purposes and various lubricating purposes.

For example, U.S. Pat. No. 1,822,886 shows the use of a mixture of materials for treating the surfaces of cylinders, pistons, valves and other surfaces affected by heat of combustion or subject to deposition of products of combustion. The mixture of components taught for this purpose r comprises approximately about 23% by volume of thinner for mineral oil, 73% by volume mineral oil, 2% by volume of trichloroethylene and 2% by volume of acetone.

U.S. Pat. No. 2,259,872 describes a flushing composition for cleaning or flushing deposits in internal combustion engines. The composition recommended for this purpose comprises 75% by volume of a mineral oil (of specific properties), 5% of dichlorobenzene and 20% by volume of isopropyl alcohol.

U.S. Pat. No. 2,320,984 defines an extreme pressure lubricating composition used in lubricating internal combustion engines and contains various halogenated carbon chain compounds and a separate organic oxygen compound.

U.S. Pat. No. 2,389,608 describes a lubricating and penetrating oil containing lubricating oil, kerosene and up to 25% cyclohexanone.

However none of these patents show a composition suitable for desludging transmission oil. Moreover none of these patents show applicant's composition or process for desludging a transmission system.

OBJECTIVES

It is an object of this invention to provide a composition and a process for dissolving sludge in the oil of a transmission system of an automobile or truck.

It is also an object of this invention to provide a composition and a process for removing the sludge from the transmission system of an automobile or truck by adding the composition of this invention to the oil in the transmission system of an automobile or truck and then removing and replacing the oil in this system.

It is also an object of this invention to provide a composition and process for extending the life of the oil in the transmission system of an automobile or truck by adding the composition of this invention and then continuing the use of this oil with the sludge dissolved therein.

Other objects will become obvious upon reading the detailed description of the invention as given hereinafter.

SUMMARY OF THE INVENTION

In accordance with the present invention, the composition and process described herein meet all of the above objectives. The composition used in the practice of this invention comprises a mixture of approximately 30–50 percent by weight toluene, 12–28 percent by weight of acetone, 12–28% dichlorobenzene, 5–15 percent by weight of a thin motor oil, such as #10 motor oil, and 5–20 percent by weight of a deodorized, denatured mineral spirits (such as kerosene) with the total being 100%. A preferred composition is 40% toluene, 20% acetone, 20% ortho-dichlorobenzene, 10% #10 motor oil and 10% kerosene.

The process of this invention comprises the step of adding the above composition to the oil in the transmission system and effecting complete mixture by operating the transmission system for an appropriate period to dissolve the sludge in the resulting mixture, and eventually discarding the transmission oil with the dissolved sludge therein. Alternatively if desired, the transmission system may be operated for a substantial period before the oil is discarded. Preferably this subsequent use is not extended to the point that further sludge is accumulated.

The amount of this solvent composition to be added depends on the size of the transmission system and the amount of oil contained therein. For example, a system using 9–14 quarts of oil is advantageously treated with approximately one quart or 35.65 ounces of the solvent composition. Smaller transmissions may be treated with one pint of the solvent mixture. Generally about 2.5–4 ounces of the mixture is used per quart of transmission oil.

While various dichlorobenzene isomers are effective in practicing this invention, the ortho-dichlorobenzene (1,2-dichlorobenzene) is preferred. Other isomers are meta- and para-dichlorobenzene, that is the 1,3- and 1,4-dichlorobenzene.

In addition to extending the life of a sludgy or highly viscous transmission oil, the composition of this invention is also useful in cleaning the inside of the transmission and in removing deposits upon removal of the used oil from the transmission system.

The invention is illustrated by the following examples which are intended merely for purpose of illustration and are not to be regarded as limiting the scope of the invention or the manner in which it may be practiced. Unless specifically indicated otherwise, parts and percentages are given by weight.

EXAMPLE I

A mixture of solvents suitable for the practice of this invention is made as follows:

| | |
|---|---|
| Toluene | 16 ounces |
| Acetone | 8 ounces |
| o-Dichlorobenzene | 8 ounces |
| #10 Motor Oil | 4 ounces |
| Kerosene | 4 ounces |

-continued

| | |
|---|---|
| | 40 ounces |

For testing purposes, 14 quarts of a highly viscous, sludgy oil is withdrawn from an automobile transmission system which is overdue for replacement of the oil. Six ounces of the above solvent mixture is added to 2 quarts of the used transmission oil. After stirring, the oil loses its sludgy appearance and becomes much less viscous.

EXAMPLE II

A mixture of solvents is prepared using the components in the amounts of Example I except that the toluene is omitted. Six ounces of the resultant mixture is added to and stirred in 2 quarts of the used transmission oil. This mixture has little effect in reducing the viscosity and the sludgy appearance of the used oil.

EXAMPLE III

A mixture of solvents is prepared using the components in the amounts of Example I except that the acetone is omitted. Six ounces of the resultant mixture is added to and stirred in 2 quarts of the used transmission oil. This mixture has little effect in reducing the viscosity and the sludgy appearance of the used oil.

EXAMPLE IV

A mixture of solvents is prepared using the components in the amounts of Example I except that the dichlorobenzene is omitted. Six ounces of the resultant mixture is added to and stirred in 2 quarts of the used transmission oil. This mixture has little effect in reducing the viscosity and the sludgy appearance of the used oil.

EXAMPLE V

A mixture of solvents is prepared using the components in the amounts of Example I except that the motor oil is omitted. Six ounces of the resultant mixture is added to and stirred in 2 quarts of the used transmission oil. This mixture has little effect in reducing the viscosity and the sludgy appearance of the used oil.

EXAMPLE VI

A mixture of solvents is prepared using the components in the amounts of Example I except that the kerosene is omitted. Six ounces of the resultant mixture is added to and stirred in two quarts of the used transmission oil. This mixture has little effect in reducing the viscosity and the sludgy appearance of the used oil.

EXAMPLE VII

Three cars are selected in which the transmission oil is overdue for replacement. In each case the transmission is acting sluggish and appears to drag on the operation of the vehicle. To each transmission there is added one quart of a mixture prepared as in Example I. Almost immediately in each case the vehicle loses its sluggish character and operates satisfactorily for a substantial period.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A process for improving the condition of a used transmission oil comprising the steps of (a) adding a solvent mixture to transmission oil consisting essentially of:

| | |
|---|---|
| Toluene | 30–50 percent by weight; |
| Acetone | 12–28 percent by weight; |
| Dichlorobenzene | 12–28 percent by weight; |
| S.A.E. No. 10 motor oil | 5–15 percent by weight; and |
| Kerosene | 5–20 percent by weight; and |

(b) thereafter operating a transmission to effect mixing of said mixture in said transmission oil.

2. The process of claim 1 in which said dichlorobenzene is ortho-dichlorobenzene.

3. The process of claim 1 in which the operation of said transmission system is continued for a substantial period after said mixing is effected.

4. The process of claim 1 in which said solvent mixture consists essentially of approximately:

| | |
|---|---|
| Toluene | 40 percent |
| Acetone | 20 percent |
| Dichlorobenzene | 20 percent |
| S.A.E. No. 10 motor oil | 10 percent |
| Kerosene | 10 percent |

5. The process of claim 4 in which said dichlorobenzene is ortho-dichlorobenzene.

* * * * *